US006932394B1

(12) United States Patent
Grillo

(10) Patent No.: US 6,932,394 B1
(45) Date of Patent: Aug. 23, 2005

(54) CROSS CONNECTING STOP APPARATUS AND METHOD

(76) Inventor: Michael A. Grillo, 4380 Grandpointe Pl., Pensacola, FL (US) 32514

( * ) Notice: Subject to any disclaimer, the term of this patent is extended or adjusted under 35 U.S.C. 154(b) by 0 days.

(21) Appl. No.: 10/607,179

(22) Filed: Jun. 25, 2003

(51) Int. Cl.[7] ..... E05C 19/18
(52) U.S. Cl. ..... 292/259 R; 292/289
(58) Field of Search ..... 292/259 R, 260, 292/292, 295, 289

(56) References Cited

U.S. PATENT DOCUMENTS 3,656,788 A * 4/1972 Emery ..... 292/148
3,752,518 A * 8/1973 Cannell ..... 292/42
5,026,102 A * 6/1991 Pitman ..... 292/259 R
5,077,940 A * 1/1992 LaRose, Jr. ..... 49/503
5,340,172 A * 8/1994 Sweet ..... 292/259 R

* cited by examiner

*Primary Examiner*—Gary Estremsky
(74) *Attorney, Agent, or Firm*—J. Nevin Shaffer, Jr.

(57) ABSTRACT

A cross connecting stop apparatus and method includes a plate with a rail, the plate attached to a movable structure, the movable structure having two sides, a top, a bottom, an inside and an outside, wherein the plate is attached to the inside of the movable structure. A bolt movably attached to the rail and a mount attached to nonmovable structure on both sides of the movable structure wherein the mount is conformed to receive the bolt on both sides of the movable structure.

12 Claims, 3 Drawing Sheets

CROSS CONNECTING STOP APPARATUS AND METHOD

FIELD OF THE INVENTION

This invention relates to a cross connecting stop apparatus and method. In particular, according to one embodiment, the invention relates to a cross connecting stop apparatus and method for use in preventing the forced opening of movable structures. More particularly, the invention relates to an apparatus and method for preventing the opening of doors, for example only and not by limitation, in a building.

BACKGROUND OF THE INVENTION

It is common for nonmovable structures to include movable structures for a variety of reasons. By way of example only and not by limitation, buildings include windows, doors, double doors, shutters, panels, and the like, for providing access for the users, light, ventilation and so forth. Whenever movable structures are added to a nonmovable structure, however, a weakness in the nonmovable structure is created. The more movable structures a nonmovable structure includes the more difficult it is to secure the nonmovable structure against unwanted intruders.

The prior art solutions include a variety of locks, chains, bolts, and the like designed to provide some measure of safety to the inhabitants of a structure once they are safely inside. The problem with most of these so-called "solutions" is that they do very little in fact to provide additional security against a determined intruder. In fact, most of the prior art solutions connect the movable structure, for example only, the door, to the door frame from which the door is hung. Because the door frame is only minimally attached to the nonmovable structure, i.e. the house, any connection from the door to the door frame is very little security in reality. That is to say, the door frame provides very little sturdy, secure, purchase area for what ever security device is attached to it. As a result, a determined kick can break through most of the chains, locks, and so forth connected from the movable structure, the door, to the door frame, for example.

This problem is known in the art and some security devices are designed to attach the movable structure to the nonmovable structure by means of a dead bolt, for example, from the door through the door frame into the nonmovable structure, or wall, of the house. In the ordinary situation, this requires the drilling of a hole in the door frame and into the wall so as to provide an opening to receive the dead bolt. While an improvement upon a connection to the door frame, the drilling of the hole necessarily weakens the vital center of the door frame and the surrounding wall and does nothing to strengthen the door itself.

A still further problem with the prior art solutions is that even if an adequate dead bolt is provided so that some increased security is achieved, the fact is that another major weakness exists in all movable structures attached to the nonmovable structure in the normal accepted manner. In the typical case, the movable structure, i.e. the door, is attached to the door frame such that the door moves open and shut on a set of two or three hinges. While the hinges are necessary to provide ease of movement, they add another high-level of the vulnerability to the inhabitants. Here again, a determined kick on the hinged side of the movable structure is usually enough to break the door free from the door frame and allow an intruder access.

Thus, there is a need in the art for providing an apparatus and method to ensure that users of nonmovable structures with movable structures therein have the ability to secure the movable structure against unwanted opening. It, therefore, is an object of this invention to provide a cross connecting stop apparatus and method for preventing the opening of movable structures within a nonmovable structure while at the same time strengthening the movable structure itself.

SUMMARY OF THE INVENTION

A cross connecting stop apparatus and method includes a plate attached to a movable structure, the movable structure having two sides, a top, a bottom, and inside and an outside, wherein the plate is attached to the inside of the movable structure. The plate includes a rail or a rail is attached to the plate. A bolt is movably attached to the rail. A mount is attached to nonmovable structure on both sides of the movable structure such that the mount is conformed to receive the bolt on both sides of the movable structure.

According to other embodiments of the invention, the bolt is a barrel bolt or a split bolt. According to another embodiment of the invention the mount is adjustable to receive the bolt a distance from the nonmovable structure. In accordance with another embodiment, the mount includes a movable bolt receiver. According to a further embodiment of the invention, the mount includes a disc with an off center bolt receiver opening, the disc movably connected to the mount.

According to another embodiment of the invention, a bolt carrier is connected to the rail and conformed to movably receive the bolt. In accordance with a further embodiment the movable structure is selected from a group including windows, doors, shutters and panels.

In accordance with another embodiment of the present invention, a method of stopping the forced entry of a movable structure attached to a nonmovable structure, the movable structure having a top, bottom, two sides, an inside and an outside, includes the step of cross connecting the inside of the movable structure to nonmovable structure on both sides of the movable structure. In accordance with a further embodiment of the method, additional steps include attaching a plate with a rail to the inside of the movable structure. Attaching a bolt carrier to the rail. Movably containing a pair of bolts within the bolt carrier. Attaching a mount to nonmovable structure on both sides of the movable structure. Connecting a movable bolt receiver to the mount such that the movable bolt receiver is conformed to receive one bolt on each side of the movable structure and moving the pair of bolts into the movable bolt receiver on both sides of the movable structure.

DESCRIPTION OF THE DRAWINGS

Other objects, features and advantages of the present invention will become more fully apparent from the following detailed description of the preferred embodiments, the appended claims and the accompanying drawings in which:

DETAILED DESCRIPTION OF THE INVENTION

Figure 1:
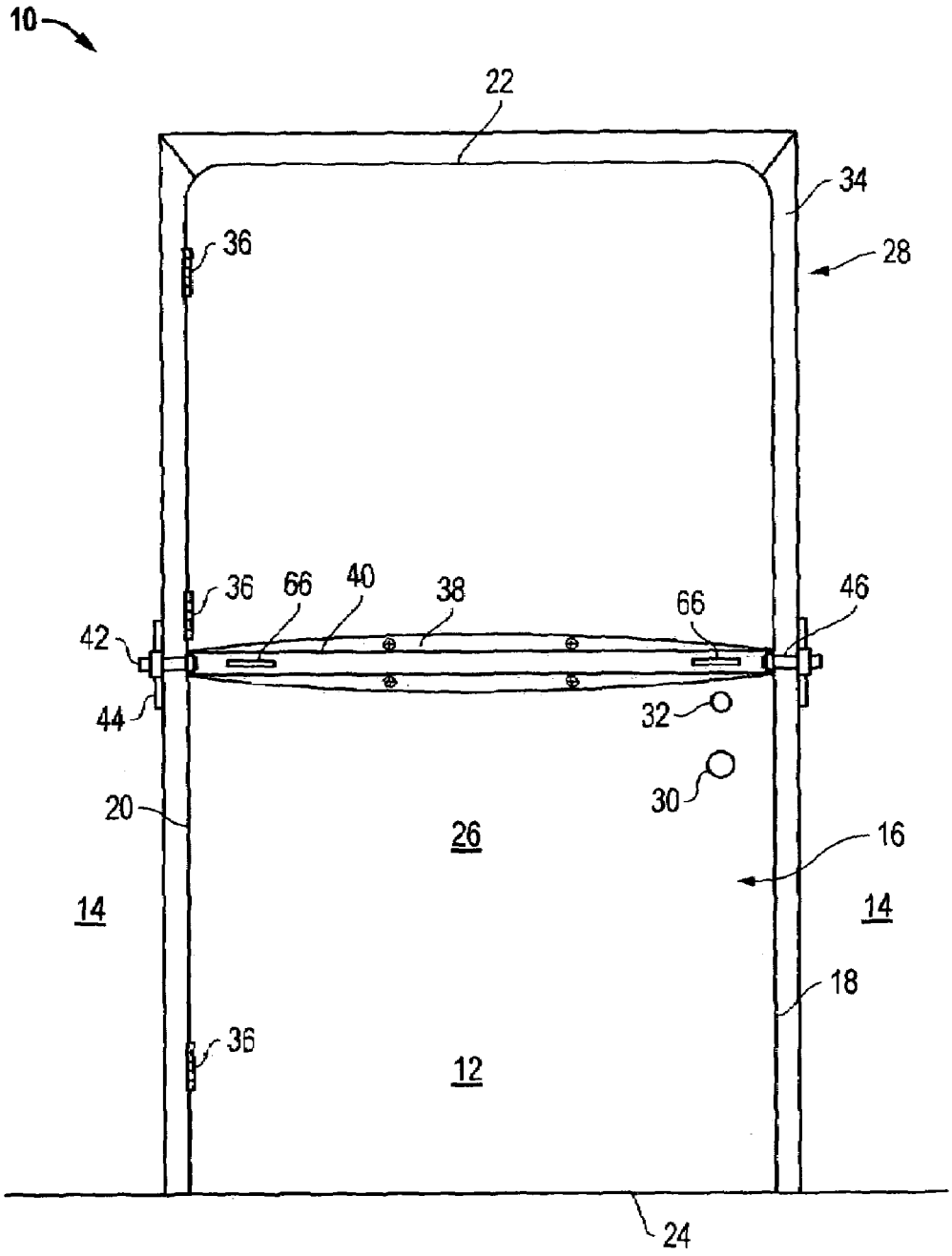
FIG. 1 is a front view of the cross connecting stop apparatus of the present invention.

An embodiment of present invention is illustrated by way of example in FIGS. 1–7. With specific reference to FIG. 1, the cross connecting stop apparatus 10 of the present invention is illustrated in connection with movable structure 12 in combination with nonmovable structure 14. As illustrated in FIG. 1, movable structure 12 happens to be a door 16 movably attached to nonmovable structure 14, a wall for example. In accordance with the present invention, however, movable structure 12 can be any movable structure in a nonmovable structure 14 now known or hereafter developed including doors, double doors, windows, shutters, and panels, for example only and not by way of limitation. Still referring to FIG. 1, movable structure 12 is, again, illustrated as a door 16. Door 16 includes two sides, side 18 and side 20, top 22, bottom 24 and inside 26. The door 16 also includes outside 28 (not shown).

Cross connecting stop apparatus 10 is designed to be attached to the inside 26 of door 16 as more fully disclosed and described hereafter. The purpose of cross connecting stop apparatus 10 is to prevent the unauthorized opening of door 16 by an intruder on the outside of the nonmovable structure 14 and to strengthen door 16 itself. As used herein, nonmovable structure 14 includes any nonmovable structure now known or hereafter developed which includes a movable structure 12. For example only and not by way of limitation, nonmovable structure 14 includes houses, barns, boats, airplanes, trains and any other residential and commercial structure of any sort whereby unauthorized entry into the nonmovable structure is desired to be prevented. Obviously, the term "nonmovable" is a relative term as used herein since boats, planes, and trains are designed to move. Still, for the purposes of this invention, "nonmovable" refers to structure considered to be nonmovable by comparison to the movable structures, doors, windows, and the like, made into the nonmovable structure.

Still referring to FIG. 1, door 16 includes door knob 30 and key lock 32. As illustrated, door 16 is shown set within a door frame 34 and attached to the door frame 34 by hinges 36. As is known in the art, door knob 30 and key lock 32 both are designed to engage the door frame 34. As illustrated, cross connecting stop apparatus 10 is attached across the inside 26 of door 16. Cross connecting stop apparatus 10 includes plate 38, rail 40, bolt 42 and a mount 44. As illustrated, mount 44 is connected, as more fully described hereafter, to the nonmovable structure 14, i.e. the wall, on both sides, side 18 and side 20, of the door 16. In operation, when bolt 42 is received by mount 34, cross connecting stop apparatus 10 prevents the unauthorized opening of the door 16, as will be more fully described hereafter.

Figure 2:
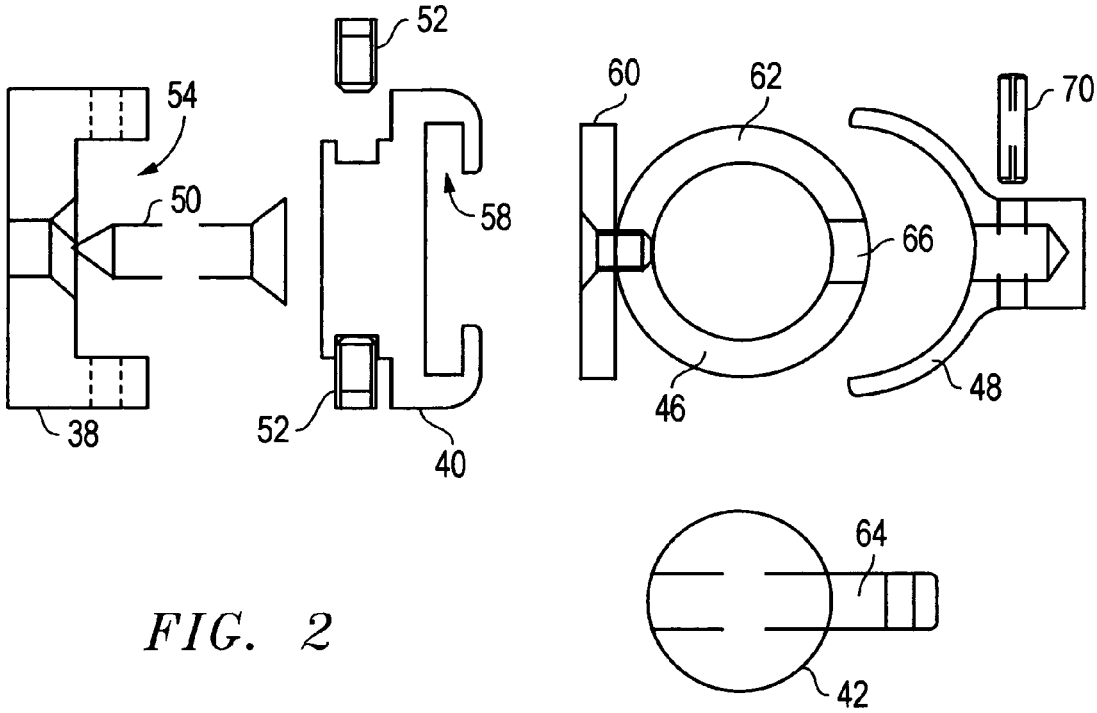
FIG. 2 is a side exploded view of the present invention.

Referring now to FIG. 2, an expanded, exploded, view of each of the relevant elements of the cross connecting stop apparatus 10, except for mount 44, are illustrated. The figure shows plate 38, rail 40 and bolt 42 illustrated. Also illustrated is bolt carrier 46 along with cover 48. As assembled, plate 38 is screwed, bolted or otherwise secured directly to and across the inside 26 of movable structure 12, door 16, by means of screws, bolts 50. Any type of attachment device for attaching plate 38 to the inside 26 of door 16 is appropriate in accordance with the invention including, epoxy, welding, or any other securing method now known or hereafter developed. It can be appreciated by those of ordinary skill that plate 38, as well as all the other elements of the invention disclosed herein, are made of the strongest available material, such as hardened steel for example only. As a result, the addition of plate 38 significantly strengthens movable structure 12, door 16, itself.

Once plate 38 is secured to the inside 26 of door 16, rail 40 is connected to plate 38 by means of retention screws 52. This feature allows a user to more easily assemble the bolt 42, bolt carrier 46 and cover 48 onto rail 40, as will be described more fully hereafter, prior to attaching the these items to plate 38. Retention screws 52, as illustrated, are used to connect the rail 40 to plate 38 by first placing rail 40 within the open C-shaped space 54 of plate 38. Thereafter, retention screws 52 are screwed through screw holes 56 in plate 38 as illustrated. It should be understood that plate 38 and rail 40 may in fact be one integral piece, as they effectively are when screwed together, for ease of manufacturing and simplicity since the bolt 42 and other elements are attachable to the integral plate 38 rail 40 combination as described above.

Prior to connecting rail 40 to plate 38, either separately or in one piece, other elements of the invention are assembled. In accordance with one embodiment of the invention, rail 40 includes a closed C-shaped channel 58. Closed C-shaped channel 58 is designed to receive projections 60 of bolt 42. In accordance with another embodiment, bolt 42 is movably retained within a bolt carrier 46. In this embodiment, bolt 42 is movably retained within bolt carrier 46 prior to the projections 60 on bolt carrier 46 being inserted within closed C-shaped channel 58.

Once bolt 42 is placed within bolt carrier 46, a pin 64 may be inserted into travel slot 66 in bolt carrier 46 so that a purchase on bolt 42 may be obtained. Thereafter, in accordance with another preferred embodiment of the invention, cover 48 is connected to pin 64 so as to cover the travel slot 66 and to provide a projection for a user to move bolt 42. Cover 48 is attached by any means known in the art such as retaining pin 70.

Figure 3:
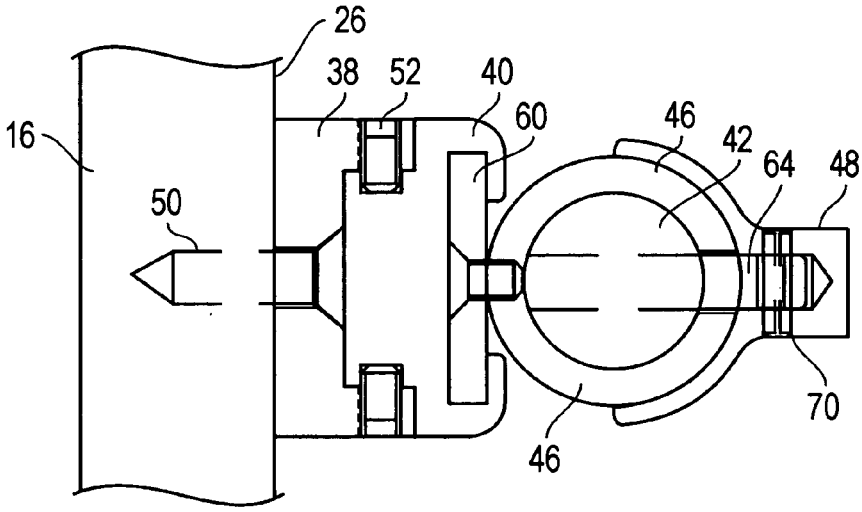
FIG. 3 is a side assembled view of the present invention.

Referring now to FIG. 3, a fully assembled cross connecting stop apparatus 10 of the present invention is illustrated. According to this embodiment, screws, bolts 50 are directly attached to the inside 26 of door 16 with a sufficient number of screws 50 to make plate 38 essentially unremovable from the inside 26 of door 16. Next, projections 60 are slid within closed C-shaped channel 58 of rail 40. Then bolt 42 is slid within bolt carrier 46, according to one embodiment, and pin 64 is connected to bolt 42. Thereafter, cover 48 is attached to pin 64 and rail 40 is securely attached to plate 38 by means of retaining screws 52.

Figure 4:
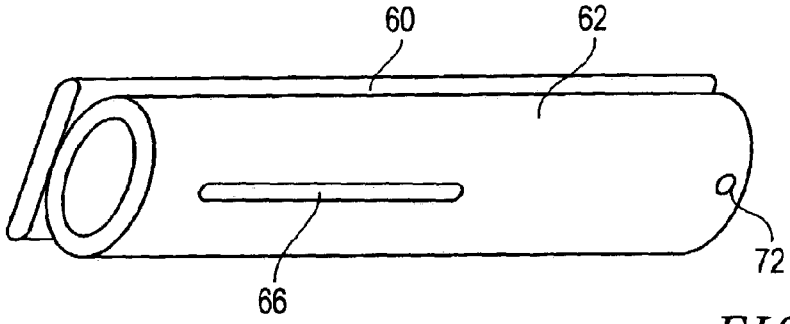
FIG. 4 is a front perspective view of the bolt carrier of the present invention.

Referring now to FIG. 4, travel slot 66 in bolt carrier 46 is fully illustrated. Additionally, projections 60 attached to bolt carrier 46 in this embodiment are fully illustrated. Additionally, screw hole 72 is illustrated such that bolt carrier 46 may be firmly attached by screws, not shown, to rail 40 such that bolt carrier 46 does not move. As is obvious to one of ordinary skill, travel slot 66 allows bolt carrier 46 to contain the bolt 42 within bolt carrier 46 and to limit bolt 42 movement to the limits of travel slot 66. According to one embodiment, a pair of bolts 42 are retained within bolt carrier 46 so as to provide cross connectability on both sides, 18 and 20, of door 16. It should be pointed out, again, that bolt 42 may include projections 60 and bolt carrier 46 may be dispensed with if desired. As illustrated in FIGS. 1, 2 and 3, according to one embodiment, bolt 42 is a barrel bolt and according to another embodiment of the invention, the bolt is a split bolt, meaning a bolt in at least two parts.

Figure 5:
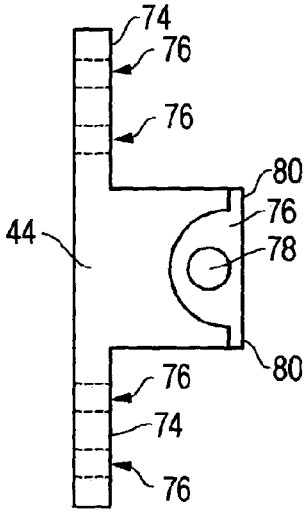
FIG. 5 is a side view of the mount of the present invention.

Now referring to FIG. 5, mount 44 is illustrated. According to one embodiment, mount 44 includes extended base 74 with screw holes 76 shown in dotted lines. Mount 44 includes a bolt receiver 76 with a bolt hole 78. Bolt receiver 76 is attached to mount 44 so that it may be adjusted towards extended base 74 or away from extended base 74. Screws 80 adjust this distance in order to accommodate bolt 42 as attached to door 16, interference from door frame 34 or any other difference in alignment with bolt hole 78.

Figure 6:
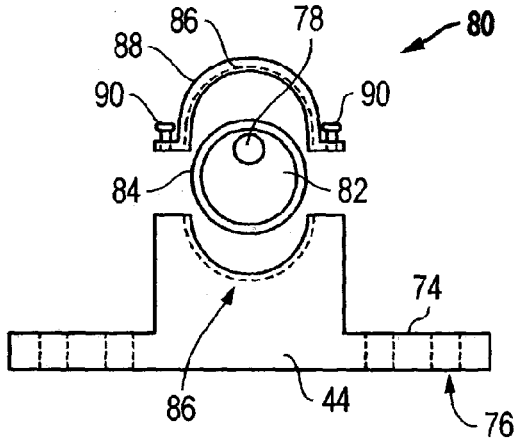
FIG. 6 is an exploded view of another embodiment of the mount of the present invention.
Figure 7:
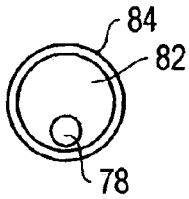
FIG. 7 is a top view of the disc of the mount of the present invention as illustrated in FIG. 6.

Referring now to FIGS. 6 and 7, another embodiment of mount 44 includes a moveable bolt receiver 80. Movable bolt receiver 80 includes disc 82 with an off center, eccentrically located bolt hole 78 and retaining edge 84. Retaining edge 84 is conformed to be held within retaining groove 86 (shown in dotted lines) in mount 44. Additionally, removable cap 88 includes retaining groove 86. Removable cap 86 is secured to mount 44 by screws 90. Comparing the position of bolt hole 78 in disc 82 in FIG. 6 with the position in FIG. 7 it can be understood that when screws 90 are loosened, disc 82 may be rotated within groove 86 so as to effectively adjust the distance of the bolt hole 78 from mount 44 so as to accommodate bolt 42 as discussed above.

In operation, a user assembles the cross connecting stop apparatus 10 as described above and attaches it to the inside 26 of movable structure 12. Mount 44 is attached to nonmovable structure 14 on both sides, 18 and 20, of movable structure 12. Once inside nonmovable structure 14, a user slides bolt 42 into mount 44 on both sides of door 16 and thereby cross connects door 16 to the nonmovable structure 14. Applicant has determined that in excess of one ton of force can be resisted by a standard door when cross connecting stop apparatus 10 is in use.

The description of the present embodiments of the invention have been presented for purposes of illustration but are not intended to be exhaustive or to limit the invention to the form disclosed. Many modifications and variations will be apparent to those of ordinary skill in the art. For example only, some doors have decorative molding on the inside. In order to accommodate such molding without having to disturb it, plate/rail combinations may be made in several shorter segments and attached to the inside of the door on either side of the molding as described and still accomplish the purposes of the invention. As such, while the present invention has been disclosed in connection with the preferred embodiments thereof, it should be understood that there may be other embodiments which fall within the spirit of the invention as disclosed defined by the following claims.

What is claimed is:

1. A cross connecting stop apparatus comprising:

a) a plate with a rail, the plate attached to a movable structure, the movable structure having two sides, a top, a bottom, an inside and an outside, wherein the plate is attached to the inside of the movable structure;

b) a bolt movably attached to the rail; and c) a mount attached to nonmovable structure on each side of the movable structure wherein each mount is conformed to receive the bolt on each side of the movable structure and wherein each mount further comprises a disc with an off center bolt receiver opening, the disc movably connected to the mount.

2. The apparatus of claim 1 wherein the mount is adjustable so as to receive the bolt a distance from the nonmovable structure.

3. The apparatus of claim 1 wherein the mount further comprises a movable bolt receiver.

4. The apparatus of claim 1 further comprising a bolt carrier connected to the rail and conformed to movably receive the bolt.

5. The apparatus of claim 1 wherein the movable structure is selected from a group including: windows, doors, double doors, shutters and panels.

6. For a movable structure in a nonmovable structure, the movable structure having a top, bottom, two sides, an inside and an outside, a cross connecting stop apparatus comprising;

a) a plate with a rail, the plate attached to the inside of the movable structure;

b) a pair of bolts movably attached to the rail; and c) a mount attached to nonmovable structure on each side of the movable structure wherein each mount is conformed to receive one bolt on each side of the movable structure and wherein each mount is adjustable so as to receive the bolt a distance from the nonmovable structure and wherein each mount further comprises a disc with an off center bolt receiver opening, the disc movably connected to the mount.

7. The apparatus of claim 6 further comprising a bolt carrier connected to the rail and conformed to movably receive the pair of bolts.

8. The apparatus of claim 6 wherein the mount further comprises a movable bolt receiver.

9. The apparatus of claim 6 wherein the movable structure is selected from a group including windows, doors, double doors, shutters and panels.

10. For a movable structure in a wall, the movable structure having a top, bottom, two sides, an inside and an outside, a cross connecting stop apparatus comprising;

a) a plate with a rail, the plate attached to the inside of the movable structure;

b) a bolt carrier attached to the rail;

c) a pair of bolts movably contained within the bolt carrier;

d) a wall mount attached to a wall on each side of the movable structure; and e) a movable bolt receiver connected to each wall mount wherein the movable bolt receiver is conformed to receive one bolt on each side of the movable structure and wherein the movable bolt receiver comprises a disc with an off center bolt receiver opening, the disc movably connected to the wall mount.

11. The apparatus of claim 10 wherein the movable structure is selected from a group including windows, doors, double doors, shutters and panels.

12. A method of stopping the forced entry of a movable structure attached to a nonmovable structure, the movable structure having a top, bottom, two sides, an inside and an outside, the method comprising the steps of:

a) attaching a plate with a rail to the inside of the movable structure;

b) attaching a bolt carrier to the rail;

c) movably containing a pair of bolts within the bolt carrier;

d) attaching a mount to nonmovable structure on each side of the movable structure;

e) connecting a movable bolt receiver to each mount, the movable bolt receiver conformed to receive one bolt on each side of the movable structure, and movably connecting a disc with an off center bolt receiver opening to each mount;

f) moving the pair of bolts into the mount on each side of the movable structure; and g) cross connecting the inside of the movable structure to nonmovable structure on each side of the movable structure.

* * * * *